US011029633B2

(12) United States Patent
Arai

(10) Patent No.: US 11,029,633 B2
(45) Date of Patent: Jun. 8, 2021

(54) FIXING DEVICE AND IMAGE FORMING APPARATUS INCORPORATING SAME

(71) Applicant: Daisuke Arai, Tokyo (JP)

(72) Inventor: Daisuke Arai, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/662,652

(22) Filed: Oct. 24, 2019

(65) Prior Publication Data

US 2020/0174406 A1 Jun. 4, 2020

(30) Foreign Application Priority Data

Nov. 29, 2018 (JP) ..... JP2018-223414

(51) Int. Cl.
*G03G 15/20* (2006.01)

(52) U.S. Cl.
CPC ..... *G03G 15/206* (2013.01); *G03G 15/2064* (2013.01); *G03G 2215/2009* (2013.01)

(58) Field of Classification Search
CPC ..... G03G 15/206; G03G 15/2064; G03G 2215/2009
See application file for complete search history.

(56) References Cited

U.S. PATENT DOCUMENTS

2018/0059598 A1* 3/2018 Hasegawa ..... G03G 15/2028

FOREIGN PATENT DOCUMENTS

| | | |
|---|---|---|
| JP | 5-134497 | 5/1993 |
| JP | 2015-210312 | 11/2015 |
| JP | 2018-036616 | 3/2018 |

* cited by examiner

*Primary Examiner* — Clayton E. LaBalle
*Assistant Examiner* — Michael A Harrison
(74) *Attorney, Agent, or Firm* — Harness, Dickey & Pierce, P.L.C.

(57) ABSTRACT

A fixing device includes a fixing belt stretched taut around a plurality of supports, a pressure rotator to form a fixing nip between the fixing belt and the pressure rotator, a belt polishing mechanism to polish the fixing belt. The belt polishing mechanism includes a polishing roller to separably contact the fixing belt and slide over the surface of the fixing belt when the polishing roller is pressed against the fixing belt, a contact and separation driver to press and separate the polishing roller to and from the fixing belt, an opposed member disposed opposite the polishing roller via the fixing belt and configured to form a polishing nip with the fixing belt, and a polishing roller rotation mechanism to rotate the polishing roller. The polishing roller rotation mechanism includes a first rotator disposed coaxially with the polishing roller and a second rotator disposed coaxially with the opposed member.

14 Claims, 4 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119 to Japanese Patent Application No. 2018-223414, filed on Nov. 29, 2018 in the Japan Patent Office, the entire disclosure of which is hereby incorporated by reference herein.

BACKGROUND

Technical Field

Embodiments of the present disclosure generally relate to a fixing device and an image forming apparatus incorporating the fixing device.

Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such a fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes an improved fixing device that includes a rotatable fixing belt, a pressure rotator, and a belt polishing mechanism. The rotatable fixing belt is stretched taut around a plurality of supports. The pressure rotator is configured to form a fixing nip between the fixing belt and the pressure rotator. The belt polishing mechanism is configured to polish a surface of the fixing belt and includes a polishing roller, a contact and separation driver, an opposed member, and a polishing roller rotation mechanism. The polishing roller is configured to separably contact the fixing belt and slide over the surface of the fixing belt when the polishing roller is pressed against the fixing belt. The contact and separation driver is configured to press and separate the polishing roller to and from the fixing belt. The opposed member is disposed opposite the polishing roller via the fixing belt and configured to form a polishing nip with the fixing belt. The polishing roller rotation mechanism is configured to rotate the polishing roller and includes a first rotator disposed coaxially with the polishing roller and a second rotator disposed coaxially with the opposed member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
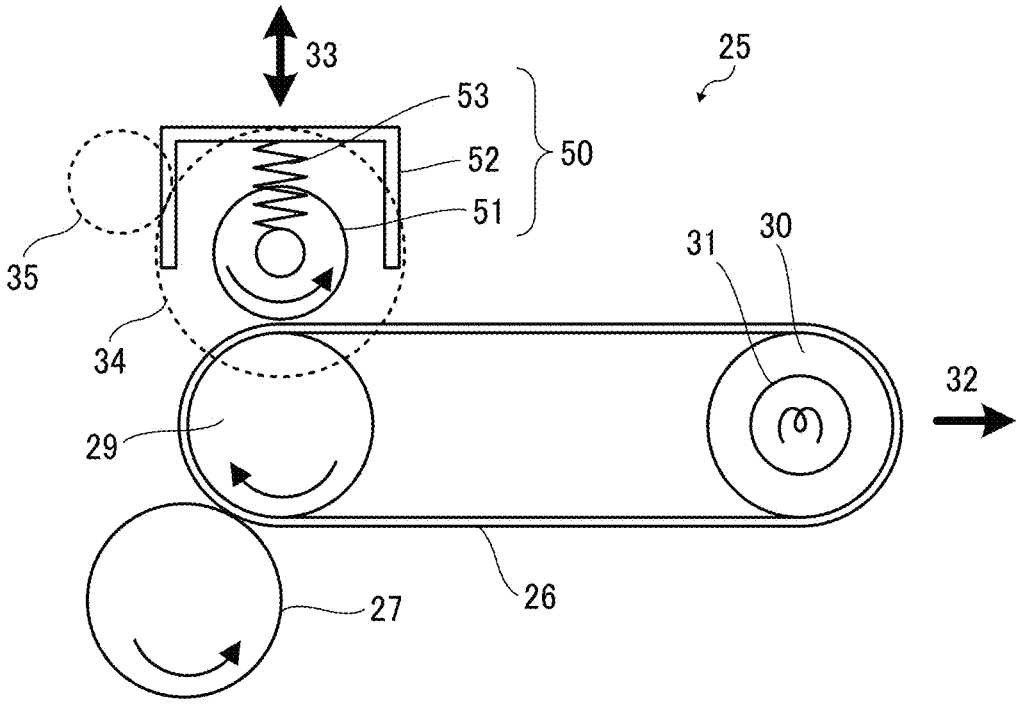
FIG. 1 is a schematic diagram illustrating a configuration of a comparative fixing device having a polishing roller.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference numbers are allocated to elements having the same function or shape and redundant descriptions thereof are omitted below.

In an electrophotographic image forming apparatus, toner image is transferred onto a recording medium such as a sheet, and the fixing device fixes the toner image onto the recording medium by heat and pressure and conveys the recording medium.

The fixing device generally includes a fixing roller and a pressure roller, and the fixing device in, e.g., a commercial printer includes a fixing belt to achieve high-speed printing, maintain a heat storage capability, and fix a toner image onto a sheet even if the sheet has an uneven surface.

A description is provided of a configuration of a comparative fixing device. An electrophotographic image forming apparatus forms toner images of various sizes on sheets of various sizes and thicknesses.

After a plurality of small sheets is conveyed through the comparative fixing device, when a large sheet is conveyed through the comparative fixing device, a fixing belt may generate a gloss streak on the toner image on the large sheet at a portion of the fixing belt over which a lateral edge of the small sheets has slid. While the small sheets are conveyed over the fixing belt, the lateral edge of the small sheets may damage the fixing belt with a streaked scratch. Since burrs on a machined edge of the small sheet produce the streaked scratch on the fixing belt, the streaked scratch on the fixing belt is conspicuous as the number of the small sheets conveyed over the fixing belt increases.

Exchanging the fixing belt deletes the gloss streak, but to reduce time and cost required to exchange the fixing belt, the comparative fixing device includes a polishing roller that restores the fixing belt damaged with the streaked scratch. The polishing roller polishes the fixing belt, removes the scratches on the fixing belt, prevents the occurrence of the gloss streaks, and lengthens a life of the fixing belt.

During maintenance, a spring and a cam press the polishing roller against the fixing belt to polish the fixing belt, and after maintenance, for example, during printing, the polishing roller separates from the fixing belt. Therefore, in order to shorten the polishing time and prevent the occurrence of a polishing deviation in a width direction of the fixing belt, adjusting the pressure of the polishing roller is important.

However, the state of the fixing belt and the state of the polishing roller are not always constant. In addition, to reduce the polishing time and obtain the desired polishing, the fixing device may have different polishing modes such as use of multiple polishing rollers having different surface roughness. The load required for polishing in each case is not constant. Therefore, adjusting the polishing roller is needed in each case. Changing the design of the fixing device slightly also requires adjustment of the polishing roller.

Figure 2:
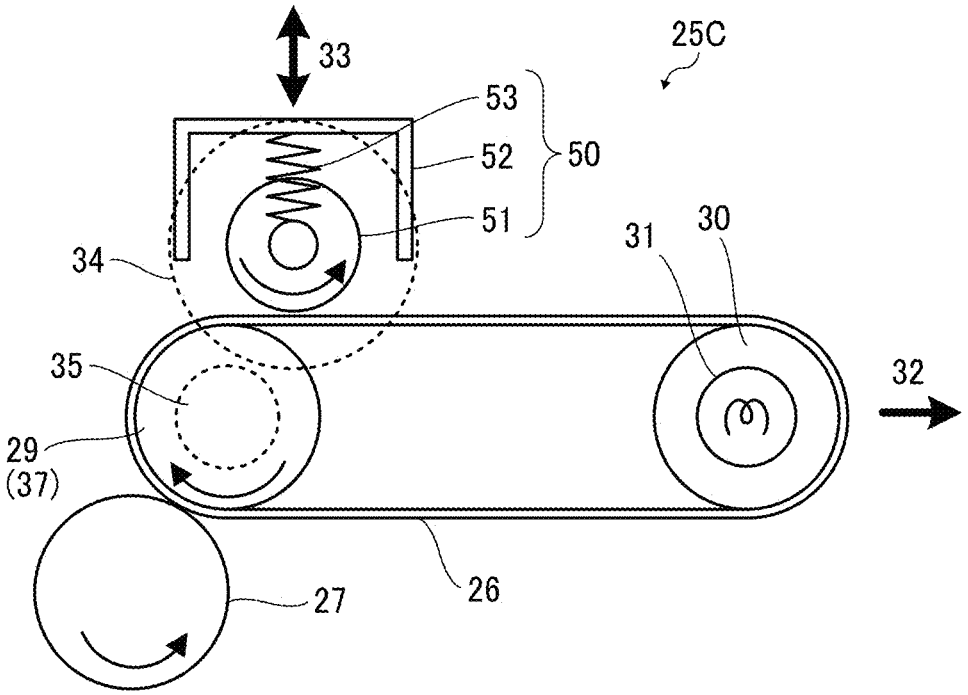
FIG. 2 is a schematic diagram illustrating a configuration of an example of a fixing device according to an embodiment of the present disclosure.
Figure 3:
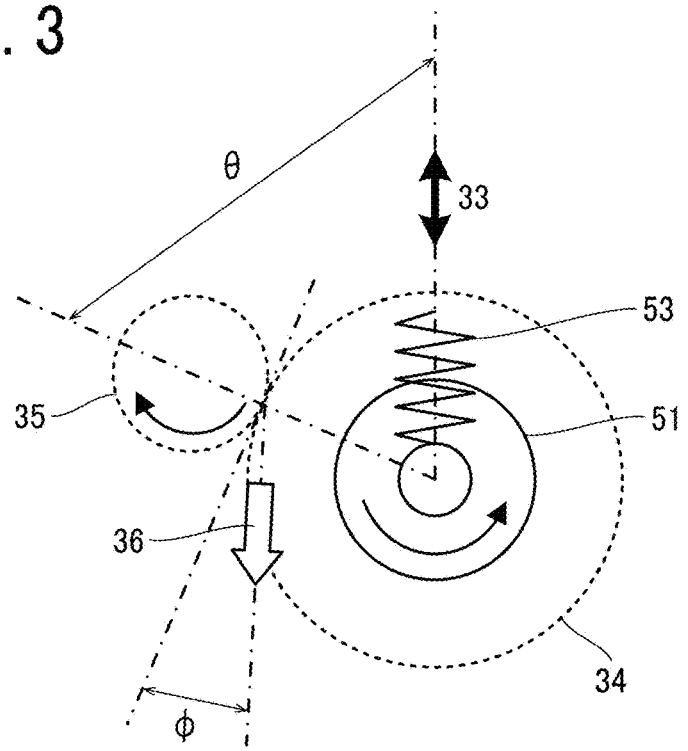
FIG. 3 is an explanatory diagram illustrating an arrangement of a polishing roller rotation mechanism in the fixing device of FIG. 1.
Figure 4:
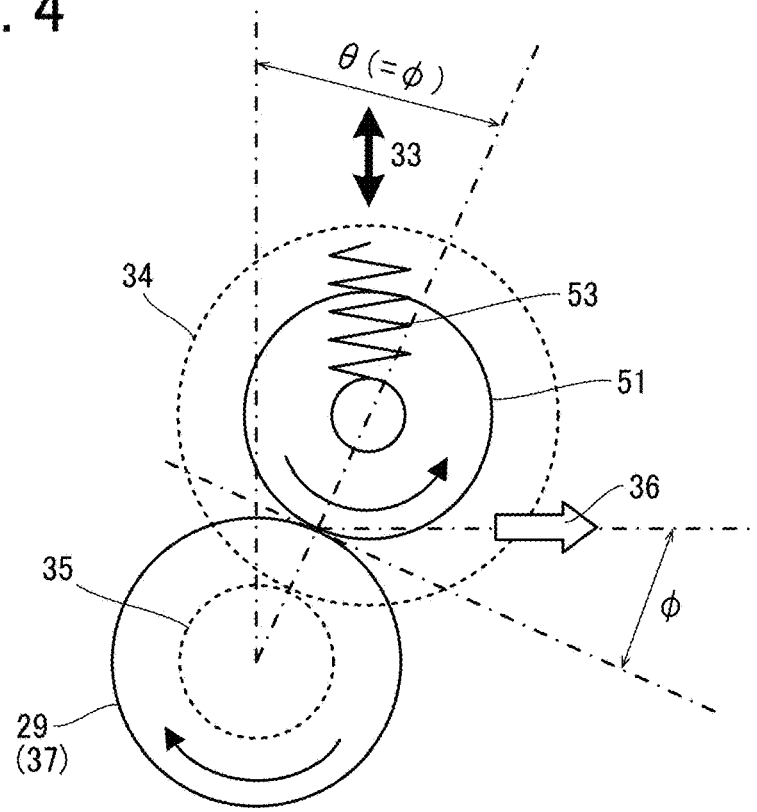
FIG. 4 is an explanatory diagram illustrating an arrangement of the polishing roller rotation mechanism in the fixing device according to an embodiment of the present disclosure.

FIGS. 1 to 4 illustrate schematic configurations of fixing devices having polishing rollers. FIGS. 1 and 3 illustrate the comparative fixing device, and FIGS. 2 and 4 illustrate a fixing device according to an embodiment of the present disclosure.

Each of the fixing device 25 according to the present embodiment and the comparative fixing device 25C includes a fixing belt 26 stretched around a plurality of supports and configured to rotate, a pressure rotator 27 such as a pressure roller that forms a fixing nip with the fixing belt 26, and a belt polishing mechanism 50 configured to polish the surface of the fixing belt 26.

The belt polishing mechanism 50 is provided so as to contact and separate from the fixing belt 26. The belt polishing mechanism 50 includes the polishing roller 51 configured to slide over the surface of the fixing belt 26 when the polishing roller 51 is pressed against the fixing belt 26, a contact and separation driver configured to press and separate the polishing roller 51 to and from the fixing belt 26, an opposed member such as an opposed rotator disposed opposite the polishing roller 51 via the fixing belt 26 to form a polishing nip with the fixing belt 26, and a polishing roller rotation mechanism configured to rotate the polishing roller 51.

The plurality of supports to stretch the fixing belt 26 includes a fixing roller 29 disposed opposite the pressure rotator 27 via the fixing belt 26 to form the fixing nip between the pressure rotator 27 and the fixing belt 26 and a heating roller 30 to heat the fixing belt 26. The heating roller 30 includes a heater 31 inside.

In addition, in order to apply tension to the fixing belt 26, a spring urges the heating roller 30 in a direction indicated by an arrow 32.

The belt polishing mechanism 50 is disposed near an opposed rotator 37.

The opposed rotator 37 may be at least one of the plurality of supports or may be a fixed member separate from the plurality of supports.

When the opposed rotator 37 is one of the supports, the opposed rotator 37 is preferably the fixing roller 29 that presses against the pressure rotator 27 via the fixing belt 26 to form the fixing nip between the fixing belt 26 and the pressure rotator 27.

Hereinafter, an aspect in which the opposed rotator 37 is the fixing roller 29 is described.

A polishing unit includes the polishing roller 51 to polish the fixing belt 26, a swing 53 to press the polishing roller 51 against the fixing belt 26, a holder 52 to hold the polishing roller 51, and the polishing roller rotation mechanism to rotate the polishing roller 51.

The polishing roller rotation mechanism includes a first rotator disposed coaxially with the polishing roller 51 to drive the polishing roller 51, hereinafter referred to as a "polishing roller drive gear 34", and a second rotator to transmit a driving force from a drive source (for example, a motor) to the first rotator, hereinafter referred to as a "drive transmission gear 35".

The polishing roller drive gear 34 is disposed on one side of the polishing roller 51 not to interfere with the fixing belt 26.

As illustrated in FIGS. 1 and 3, the comparative fixing device 25C includes the drive transmission gear 35 as the second rotator that is arranged on the circumference of the polishing roller drive gear 34 as the first rotator.

The drive transmission gear 35 is disposed at a position that does not overlap the projection surface of the opposed rotator such as the fixing roller 29 to avoid interference with the fixing roller 29 as the opposed rotator.

For example, as illustrated in FIG. 3, the drive transmission gear 35 is disposed with a shaft serving as the rotation fulcrum at a position at which a pressing direction indicated by an arrow 33 and a center line connecting the center of the polishing roller drive gear 34 and the center of the drive transmission gear 35 intersect at an angle $\theta$.

In transmission of the driving force from the drive transmission gear 35 to the polishing roller drive gear 34, a load to rotate the polishing roller 51 generates a gear meshing force (N) indicated by an arrow 36.

A pressure angle $\varphi$ determines a direction in which the gear transmits force, and the gear meshing force (N) indicated by the arrow 36 is applied in the direction of $90°+\varphi$ with respect to the center line connecting the center of the polishing roller drive gear 34 and the center of the drive transmission gear 35.

Since this gear meshing force (N) indicated by the arrow 36 is applied to the polishing roller 51, a force represented by the following formula (1) is added to the pressing force of the polishing roller 51, which generates a deviation of a force corresponding to the value.

$$N \sin(\theta+\varphi) \quad \text{Formula (1)}$$

For example, when N is 10 N, θ is 45°, and φ is 20°, the value of formula (1) is 9.1 N.

In contrast, in the fixing device 25 of the present embodiment, as illustrated in FIGS. 2 and 4, the polishing roller rotation mechanism includes the polishing roller drive gear 34 as the first rotator disposed coaxially with the polishing roller 51 and the drive transmission gear 35 as the second rotator disposed coaxially with the opposed rotator.

In addition to the arrangement of the drive transmission gear 35 disposed coaxially with the opposed rotator 37 that is the fixing roller 29, related parts are arranged so that the angle θ formed by the pressing direction indicated by the arrow 33 and the center line connecting the centers of the polishing roller drive gear 34 and the center of the drive transmission gear 35 is equal to the pressure angle φ.

This arrangement causes the value of the above formula (1) to be 0 regardless of the value of the gear meshing force (N) indicated by the arrow 36, and the pressing deviation on the polishing roller 51 can be completely eliminated.

In the present embodiment, the arrangement of the drive transmission gear 35 disposed coaxially with the opposed rotator 37 that is the fixing roller 29 does not need an independent shaft of the drive transmission gear 35 that serves as a rotation fulcrum.

Additionally, in the present embodiment, since the polishing roller 51 and the opposed rotator 37 (fixing roller 29) determine the appropriate positions of the gear shaft centers, a mechanism required in the comparative fixing device 25C is not needed to suitably position the gear shaft centers in the present embodiment.

The above-described configuration in the fixing device 25 of the present embodiment enables the polishing roller 51 to uniformly contact and press against the fixing belt 26 to be polished and ensure a sufficient contact area. Therefore, the above-described configuration can reduce the cost and size of the device and the polishing time required for rejuvenating the surface properties and prevent the occurrence of polishing deviations.

The fixing belt 26 may be, for example, an endless belt having a multilayer structure in which a release layer and an elastic layer made of silicone rubber or the like are sequentially laminated on a base layer made of polyimide resin (PI) and having a layer thickness of 90 μm.

The elastic layer of the fixing belt 26 may have, for example, a layer thickness of about 200 μm and may be formed of an elastic material such as silicone rubber, fluorine rubber, and silicone rubber foam.

The release layer of the fixing belt 26 may have, for example, a layer thickness of about 20 micrometers and may be made of tetrafluoroethylene-perfluoroalkylvinylether copolymer (PFA), polyimide (PI), polyether imide (PEI), polyether sulfide (PES), or the like. Providing the release layer on the surface layer of the fixing belt 26 ensures the releasability (removability) with respect to the toner (toner image) and a good separation performance between the fixing belt 26 and a recording medium such as a sheet having the toner image that is well fixed.

The polishing roller 51 includes a core bar 51*a* and a slide layer 51*b* disposed on the core bar 51*a*. The slide layer 51*b* serves as an abrasive grain layer or a polishing layer, for example. The slide layer 51*b* as a surface layer includes a binder resin and abrasive grains 51*c* dispersed in the binder resin. The abrasive grains 51*c* project beyond an outer circumferential surface of the slide layer 51*b* to define slight surface asperities. The abrasive grains 51*c* are alumina abrasive grains as general abrasive particles, for example, white fused alumina #1500. Alternatively, the abrasive grains 51*c* may be made of other materials. The grain size of the abrasive grains 51*c* may be identical throughout the entire slide span of the polishing roller 51 that slides over the fixing belt 26.

The heater 31 incorporated in the heating roller 30 may be, for example, a halogen heater or an induction heating (IH) device that is an electromagnetic induction heating device.

As described above, the opposed rotator 37 may be at least one of the plurality of supports to stretch the fixing belt 26 or may be a fixed member separate from the plurality of supports. When the opposed rotator 37 is one of the supports, the opposed rotator 37 may be the fixing roller 29.

Preferably, the rotational speed of the opposed rotator 37 that is a rotating member is different from the rotational speed of the drive transmission gear 35 as the second rotator disposed coaxially with the opposed rotator 37.

In addition, preferably the drive transmission gear 35 as the second rotator transmits the driving force to the polishing roller drive gear 34 as the first rotator when the polishing roller 51 is pressed against the fixing belt 26.

This configuration can control the transmission of the driving force so that the driving force is transmitted when the polishing roller 51 is pressed against the fixing belt 26 and not transmitted when the polishing roller 51 separates from the fixing belt 26.

Preferably, the polishing roller 51 is rotationally driven at a speed different from the surface speed of the fixing belt 26 that is rotationally driven.

The surface speed of the polishing roller 51 with respect to the surface speed of the fixing belt 26 is not particularly limited and can be selected as appropriate. For example, the polishing roller 51 may rub the surface of the fixing belt 26 at the speed three times faster than the speed of the fixing belt 26 in a forward direction.

Accordingly, the polishing roller 51 contacts the fixing belt 26 in the sufficient contact area, improving a polishing quality and decreasing the polishing time taken to restore the outer circumferential surface of the fixing belt 26.

Figure 5:
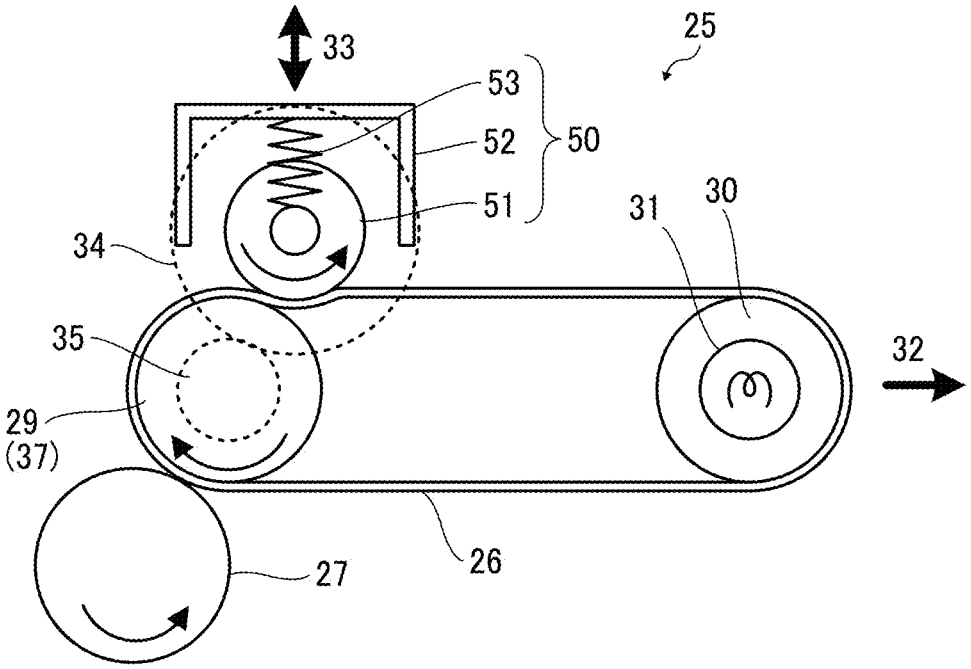
FIG. 5 is a schematic diagram illustrating a configuration of an example of the fixing device according to an embodiment of the present disclosure, in which the polishing roller is pressed against a fixing belt to change a rotation locus of the fixing belt.

In the fixing device 25 according to the present embodiment, as illustrated in FIG. 5, while the polishing roller 51 is pressed against the fixing belt 26, the polishing roller 51 is disposed opposite the opposed rotator 37 via the fixing belt 26 to form the polishing nip between the polishing roller 51 and the fixing belt 26 and changes a rotation locus of the fixing belt 26 along at least a part of a circumferential face of the polishing roller 51.

Specifically, the polishing roller 51 is preferably set so that a wound angle is equal to or greater than 10° and more preferably set so that the wound angle is equal to or greater than 20°. The wound angle is an angle formed by a straight line connecting a center of the polishing roller 51 and a center of the opposed rotator 37 and a straight line passing through the center of the polishing roller 51 and being perpendicular to the outer circumferential surface of the fixing belt 26.

A surface layer of at least one of the polishing roller 51 and the opposed rotator 37 preferably includes an elastic body.

In order to bring the polishing roller 51 into contact with the fixing belt 26, the polishing roller 51 may move toward the opposed rotator 37 or the opposed rotator 37 may move toward the polishing roller 51.

The polishing roller 51 may be removably attached to the fixing device 25 so that a user attaches the polishing roller 51 to the fixing device 25 to cause the polishing roller 51 to polish the fixing belt 26 and removes the polishing roller 51 when the polishing roller 51 does not polish the fixing belt 26.

Figure 6:
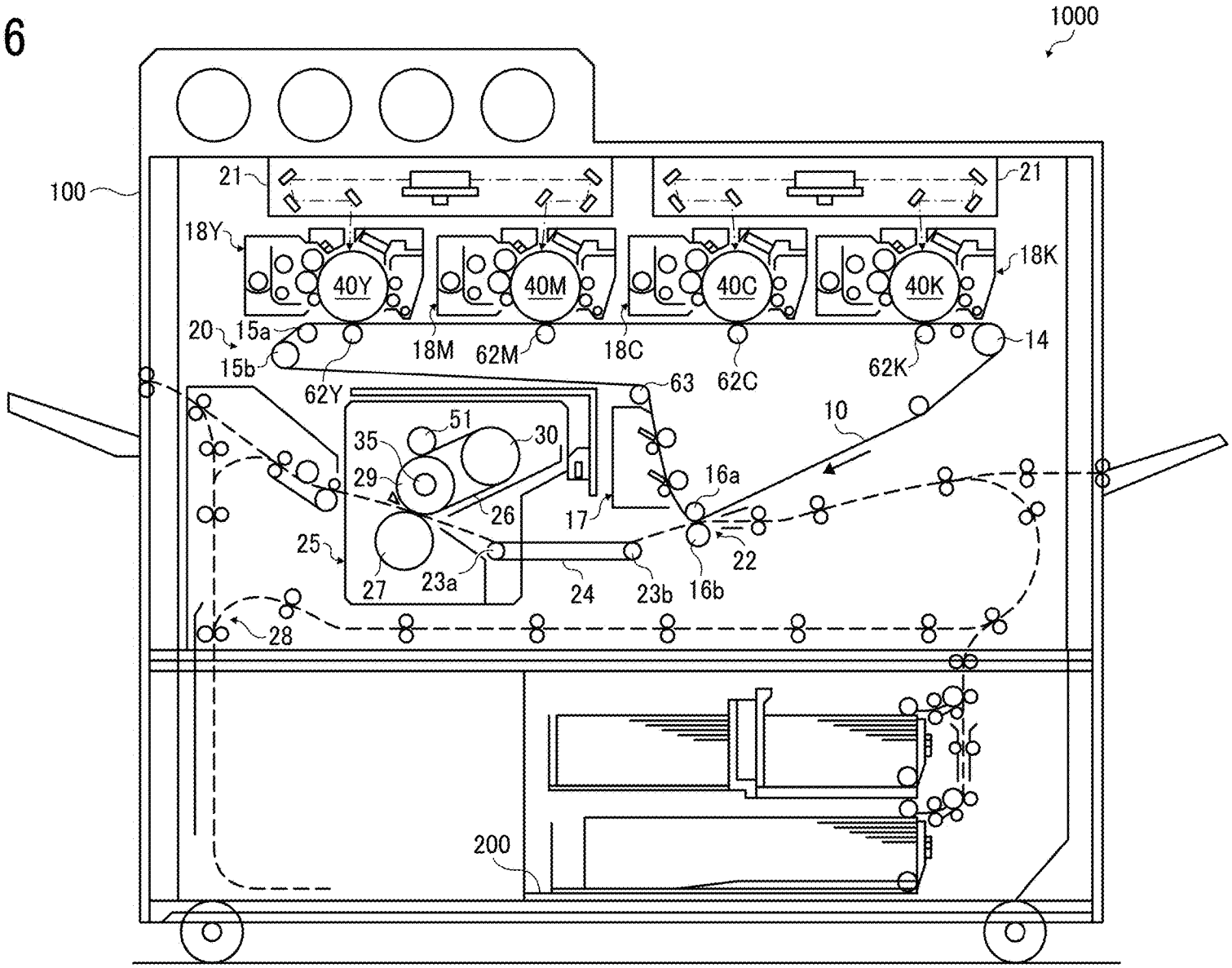
FIG. 6 is a schematic diagram illustrating a configuration of an image forming apparatus according to an embodiment of the present disclosure.

With reference to FIG. 6, a description is provided of an image forming apparatus including the fixing device according to an embodiment of the present disclosure. FIG. 6 is a schematic diagram illustrating a configuration of the image forming apparatus. As illustrated in FIG. 6, the image forming apparatus 1000 is a printer employing a tandem intermediate transfer system. The image forming apparatus 1000 includes a body 100 and a sheet feed table 200 mounting the body 100.

The body 100 accommodates an image forming section 20 employing the tandem intermediate transfer system (hereinafter referred to as a tandem image forming section). The image forming section 20 includes a plurality of image forming devices 18Y, 18M, 18C, and 18K aligned horizontally. Suffixes Y, M, C, and K represent yellow, magenta, cyan, and black, respectively.

An intermediate transfer belt 10 as an endless belt type intermediate transferor is situated in a sheet conveyance region and in a substantially center portion of the body 100. The intermediate transfer belt 10 is looped over a plurality of rollers, that is, an intermediate transfer belt driving roller 14, intermediate transfer belt support rollers 15*a* and 15*b*, a secondary-transfer backup roller 16*a*, and the like. The intermediate transfer belt 10 is rotatable clockwise in FIG. 6.

On the left of the secondary-transfer backup roller 16*a*, a belt cleaner 17 is disposed to clean the intermediate transfer belt 10. The belt cleaner 17 removes residual toner remaining on the intermediate transfer belt 10 after the toner image formed on the intermediate transfer belt 10 is transferred.

Above an upper face of the intermediate transfer belt 10 stretched taut around the intermediate transfer belt driving roller 14 and the intermediate transfer belt support rollers 15*a* and 15*b*, the four image forming devices 18Y, 18M, 18C, and 18K are aligned horizontally in the rotation direction of the intermediate transfer belt 10 to form yellow, magenta, cyan, and black toner images, respectively, thus constructing the tandem image forming section 20. The image forming devices 18Y, 18M, 18C, and 18K, of the tandem image forming section 20 include photoconductive drums 40Y, 40M, 40C, and 40K serving as image bearers that bear yellow, magenta, cyan, and black toner images, respectively.

As illustrated in FIG. 6, above the tandem image forming section 20, two exposure devices 21 are disposed. The left exposure device 21 is disposed opposite the two image forming devices 18Y and 18M. The right exposure device 21 is disposed opposite the two image forming devices 18C and 18K. For example, each of the exposure devices 21 employs an optical scanning method and includes two light sources (e.g., a semiconductor laser, a semiconductor laser array, or a multi-beam light source), a coupling optical system, a common optical deflector (e.g., a polygon mirror), and two scanning-image forming optical systems. The exposure devices 21 expose the photoconductive drums 40Y, 40M, 40C, and 40K according to yellow, magenta, cyan, and black image data, forming electrostatic latent images on the photoconductive drums 40Y, 40M, 40C, and 40K, respectively.

Each of the photoconductive drums 40Y, 40M, 40C, and 40K is surrounded by a developing device and a photoconductive drum cleaner. The developing device visualizes the electrostatic latent image that is formed by a charger and the exposure device 21 into a visible toner image, that is, yellow, magenta, cyan, and black toner images. Before the exposure devices 21 expose the photoconductive drums 40Y, 40M, 40C, and 40K, the chargers uniformly charge the photoconductive drums 40Y, 40M, 40C, and 40K, respectively. The photoconductive drum cleaners remove residual toner failed to be transferred onto the intermediate transfer belt 10 and therefore remaining on the photoconductive drums 40Y, 40M, 40C, and 40K therefrom, respectively.

Primary transfer rollers 62Y, 62M, 62C, and 62K serving as primary transferors are disposed opposite the photoconductive drums 40Y, 40M, 40C, and 40K via the intermediate transfer belt 10 to form primary transfer nips between the photoconductive drums 40Y, 40M, 40C, and 40K and the intermediate transfer belt 10, respectively, where the yellow, magenta, cyan, and black toner images formed on the photoconductive drums 40Y, 40M, 40C, and 40K are primarily transferred onto the intermediate transfer belt 10 as a color toner image. The primary transfer rollers 62Y, 62M, 62C, and 62K are disposed opposite the photoconductive drums 40Y, 40M, 40C, and 40K with the intermediate transfer belt 10 sandwiched between the primary transfer rollers 62Y, 62M, 62C, and 62K and the photoconductive drums 40Y 40M, 40C, and 40K, respectively.

The intermediate transfer belt driving roller 14 is a driving roller that drives and rotates the intermediate transfer belt 10. The intermediate transfer belt driving roller 14 is coupled to a motor through a driving force transmitter (e.g., a gear, a pulley, and a belt). In a print job to form a black toner image on the intermediate transfer belt 10, a mover moves the intermediate transfer belt support rollers 15*a* and 15*b* without moving the intermediate transfer belt driving roller 14. Thus, the mover isolates the intermediate transfer belt 10 from the photoconductive drums 40Y 40M, and 40C used for forming yellow, magenta, and cyan toner images, respectively.

A secondary transfer device 22 is disposed opposite the tandem image forming section 20 via the intermediate transfer belt 10. In FIG. 6, the secondary transfer device 22 includes a secondary transfer roller 16*b* pressed against the secondary-transfer backup roller 16*a* via the intermediate transfer belt 10. The secondary transfer roller 16*b* generates a transfer electric field to secondarily transfer the color toner image formed on the intermediate transfer belt 10 onto the sheet S as a transfer medium.

Downstream from the secondary transfer device 22 in a sheet conveyance direction, the fixing device 25 according to the present disclosure is disposed to fix the color toner image transferred from the intermediate transfer belt 10 onto the sheet S thereon.

A conveyance belt 24 supported by two conveyance belt support rollers 23*a* and 23*b* conveys the sheet S bearing the color toner image transferred from the intermediate transfer belt 10 by the secondary transfer device 22 to the fixing device 25. Instead of the conveyance belt 24, a stationary guide, a conveyor roller, or the like may be used.

Below the secondary transfer device 22 and the fixing device 25, a sheet reverse device 28 is disposed. The sheet reversing device 28 reverses and conveys the transfer sheet S to record images on both sides of the transfer sheet S in parallel with the tandem image forming section 20 described above.

The present disclosure is not limited to the above-described embodiments, and the configuration of the present embodiment can be appropriately modified other than suggested in each of the above embodiments within a scope of the technological concept of the present disclosure. Also, the positions, the shapes, and the number of components are not limited to the embodiments, and they may be modified suitably in implementing the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Any one of the above-described operations may be performed in various other ways, for example, in an order different from the one described above.

What is claimed is:

1. A fixing device comprising:

a rotatable fixing belt stretched taut around a plurality of supports;

a pressure rotator configured to form a fixing nip between the fixing belt and the pressure rotator;

a belt polishing mechanism configured to polish a surface of the fixing belt, the belt polishing mechanism including:

a polishing roller configured to separably contact the fixing belt and slide over the surface of the fixing belt when the polishing roller is pressed against the fixing belt;

a contact and separation driver configured to press the polishing roller to the fixing belt and configured to separate the polishing roller from the fixing belt;

an opposed member disposed opposite the polishing roller via the fixing belt and disposed opposite the pressure rotator via the fixing belt proximate to the fixing nip, the opposed member being configured to form a polishing nip between the polishing roller and the fixing belt; and a polishing roller rotation mechanism configured to rotate the polishing roller, the polishing roller rotation mechanism including a first rotator disposed coaxially with the polishing roller and a second rotator disposed coaxially with the opposed member, wherein a rotational speed of the second rotator is different from a rotational speed of the opposed member, and wherein the polishing roller is configured to rotate at a speed different from a rotational speed of the surface of the fixing belt.

2. The fixing device according to claim 1, wherein the second rotator is configured to transmit a driving force to the first rotator when the polishing roller is pressed against the fixing belt.

3. The fixing device according to claim 1, wherein the plurality of supports includes the opposed member.

4. The fixing device according to claim 3, wherein the opposed member is a fixing roller configured to press against the pressure rotator via the fixing belt to form a fixing nip between the fixing belt and the pressure rotator.

5. The fixing device according to claim 1, wherein the opposed member is a fixed member separate from the plurality of supports.

6. The fixing device according to claim 1, wherein, when the polishing roller is pressed against the fixing belt, the polishing roller is disposed opposite the opposed member via the fixing belt to form a polishing nip between the polishing roller and the fixing belt and changes a rotation locus of the fixing belt along at least a part of a circumferential face of the polishing roller.

7. An image forming apparatus comprising the fixing device according to claim 1.

8. The fixing device according to claim 1, wherein the plurality of supports includes the opposed member.

9. The fixing device according to claim 2, wherein the plurality of supports includes the opposed member.

10. An image forming apparatus comprising the fixing device according to claim 2.

11. A fixing device, comprising:

a rotatable fixing belt stretched taut around a plurality of supports;

a pressure rotator configured to form a fixing nip between the fixing belt and the pressure rotator;

a belt polishing mechanism configured to polish a surface of the fixing belt, the belt polishing mechanism including:

a polishing roller configured to separably contact the fixing belt and slide over the surface of the fixing belt when the polishing roller is pressed against the fixing belt;

a contact and separation driver configured to press the polishing roller to the fixing belt and configured to separate the polishing roller from the fixing belt;

an opposed member disposed opposite the polishing roller via the fixing belt and disposed opposite the pressure rotator via the fixing belt proximate to the fixing nip, the opposed member being configured to form a polishing nip between the polishing roller and the fixing belt; and a polishing roller rotation mechanism configured to rotate the polishing roller, the polishing roller rotation mechanism including a first rotator disposed coaxially with the polishing roller and a second rotator disposed coaxially with the opposed member, wherein the second rotator is configured to transmit a driving force to the first rotator when the polishing roller is pressed against the fixing belt, wherein the polishing roller is configured to rotate at a speed different from a rotational speed of the surface of the fixing belt.

12. An image forming apparatus comprising the fixing device according to claim 11.

13. A fixing device, comprising:

a rotatable fixing belt stretched taut around a plurality of supports;

a pressure rotator configured to form a fixing nip between the fixing belt and the pressure rotator;

a belt polishing mechanism configured to polish a surface of the fixing belt, the belt polishing mechanism including:

a polishing roller configured to separably contact the fixing belt and slide over the surface of the fixing belt when the polishing roller is pressed against the fixing belt;

a contact and separation driver configured to press the polishing roller to the fixing belt and configured to separate the polishing roller from the fixing belt;

an opposed member disposed opposite the polishing roller via the fixing belt and disposed opposite the pressure rotator via the fixing belt proximate to the fixing nip, the opposed member being configured to form a polishing nip between the polishing roller and the fixing belt; and a polishing roller rotation mechanism configured to rotate the polishing roller, the polishing roller rotation mechanism including a first rotator disposed coaxially with the polishing roller and a second rotator disposed coaxially with the opposed member, wherein a rotational speed of the second rotator is different from a rotational speed of the opposed member, wherein the second rotator is configured to transmit a driving force to the first rotator when the polishing roller is pressed against the fixing belt, and wherein the polishing roller is configured to rotate at a speed different from a rotational speed of the surface of the fixing belt.

14. An image forming apparatus comprising the fixing device according to claim 13.

* * * * *